United States Patent [19]

Francis

[11] 3,983,840

[45] Oct. 5, 1976

[54] REINKING APPARATUS

[75] Inventor: Harold M. Francis, St. Paul, Minn.

[73] Assignee: Columbia-Great Lakes Corporation, Dayton, Ohio

[22] Filed: Jan. 8, 1975

[21] Appl. No.: 539,512

[52] U.S. Cl. ..... 118/235; 118/246; 118/262

[51] Int. Cl.[2] ..... B05C 1/08

[58] Field of Search ..... 118/246, 258, 259, 262, 118/7, 235; 68/257

[56] References Cited

UNITED STATES PATENTS

| | | | |
|---|---|---|---|
| 404,653 | 6/1889 | Parker et al. | 68/257 |
| 1,975,681 | 10/1934 | Brawn | 101/364 X |
| 2,007,729 | 7/1935 | Shallcross | 118/235 X |
| 2,644,424 | 7/1953 | Bixby | 118/262 X |
| 2,649,758 | 8/1953 | Cowgill | 118/259 X |
| 3,343,484 | 9/1967 | Dahlgren | 118/262 X |
| 3,605,687 | 9/1971 | Russell | 118/262 |
| 3,647,525 | 3/1972 | Dahlgren | 118/262 X |
| 3,788,271 | 1/1974 | Carpenter et al. | 118/262 X |

*Primary Examiner*—John P. McIntosh
*Attorney, Agent, or Firm*—Biebel, French & Nauman

[57] ABSTRACT

An apparatus for reinking ribbons, including computer ribbons, comprising means for feeding the ribbon to be inked; means for collecting the reinked ribbon; drive means; guide means; inking means for applying a reinking composition to the ribbon so that it can be reused to print, including a reinking composition supply reservoir, a feed or ductor roller and an inking roller, wherein the positional relationship between the feed and inking roller determines the amount of reinking composition transferred from the reservoir to the ribbon; and cam means for adjusting the positional relationship between the feed and inking rollers.

4 Claims, 5 Drawing Figures

REINKING APPARATUS

CROSS REFERENCE TO RELATED APPLICATION

This application is related to copending application Ser. No. 539,511, filed Jan. 8, 1975, entitled "Improved Ribbon Reinking Apparatus".

BACKGROUND OF THE INVENTION

The invention is related broadly to apparatus for reinking ribbons, and specifically to an improved computer ribbon reinking apparatus having a cam means for adjusting the amount of ink transferred.

Apparatus for reinking ribbons, including computer ribbons, are known in the art, and basically comprise a feed roller, guide rollers, take-up roller, and inking fountain. Also, some means is provided to set or adjust the feed rate of the inking composition by the inking fountain. This is helpful when reinking. computer ribbons where, because of their width, different ink flow rates along the width of the ribbon can result in an unever coat of fresh ink.

An example of a prior art adjustment means is a micrometer screw type adjustment which directly adjusts the positional relationship between the ductor and inking rollers which make up the inking fountain. Such adjusting means are satisfactory for purposes of the initial adjustment of the positional relationship. But, when the apparatus is operating, a further adjustment, dictated by its operation, may require either a skilled operator capable of appreciating the precision of a micrometer setting or the stopping of the machine since it may take some time to figure out and execute the necessary adjustment.

Therefore, a need exists for an improved reinking apparatus having a relatively simple means for adjusting the amount of reinking composition transferred which means can be operated by an unskilled person to adjust the positional relationship of the rollers comprising the inking means, as well as used to make adjustments when the machine is operating.

SUMMARY OF THE INVENTION

The invention is broadly an improved ribbon reinking apparatus having cam means for adjusting the amount of reinking composition transferred by adjusting the positional relationship between the rollers comprising the inking means. Basically, the apparatus comprises means for feeding and collecting the ribbon, a means for driving the collecting means, inking means for applying a reinking composition to the ribbon, guide means for guiding the ribbon into contact with the inking means, and the means for adjusting the feed of reinking composition to the ribbon.

The inking means preferably comprises a reservoir which holds a supply of reinking composition, a feed roller which transfers an amount of reinking composition from the reservoir, and a rubber coated roller which accepts reinking composition from the feed roller and applies the reinking composition to the ribbon being reinked. The inking roller is mounted for rotation such that it is biased, by a spring means, away from, but in contact with, the feed roller. It is the amount of contact between the feed roller and the inking roller, i.e., the spatial relationship between the feed and inking rollers, which determines the amount of reinking composition which is transferred. Therefore, by controlling the spatial relationship between the feed and inking rollers, the amount of reinking composition transferred to the inking roller and hence to the ribbon is controlled.

For the purposes of this application, the phrases "spatial relationship" and "positional relationship" are intended to include the amount of contact between the feed or ductor roller and the inking roller, as well as any space or gap between the feed and inking rollers. While the ink transfer is normally done when the rollers are in contacting relationship, it is possible to transfer ink across a gap or space between the rollers if the surface tension (which can vary depending upon the temperature, concentration of ingredients, etc.) of the reinking composition is sufficient. Thus, an adjustment of the positional or spatial relationship between the feed and inking rollers can be an adjustment of the pressure or amount of contact between the rollers or an adjustment of the gap between the rollers.

In order to vary the positional relationship, a cam means is provided on the side of the inking roller which is away from, and in opposition to, the spring biasing means. The cam means can be rotated to overcome the spring biasing means to a greater or lesser degree, and to cause the positional relationship to be varied. This in turn produces consequential variances in the amount of reinking composition transferred to the inking rollers. A predetermined number of stops or rest points will be provided for the cam, such as high, medium, low, and off. Thus, an unskilled person could adjust the positional relationship by merely rotating the cam using a handle until one of the stops is found. Since the stop will be predetermined amount of adjustment, the person need not read any numbers to know when the adjustment has been enough because it will be enough when the stop has been reached.

Further, the cam is mounted for rotation such that its center of rotation can be adjusted to vary the initial spatial relationship between the feed and inking rollers. Once the spacing is set by setting the center of rotating of the cam, the rotation of the cam can provide the "fine" adjustment of the spatial relationship.

Thus, the improved apparatus for reinking ribbons provides a simple means for adjusting the amount of reinking composition transferred to the ribbon by using a simple cam means which requires only minimal skill to operate, and further, since it does not act directly, it can be used to make adjustments when the machine is in use. It is therefore an object of the invention to provide an improved apparatus for reinking ribbons which includes an improved means for varying the amount of reinking composition transferred to the ribbon.

Other objects and advantages of the invention will be apparent from the following description, the accompanying drawings and the appended claims.

DETAILED DESCRIPTION OF THE INVENTION

Figure 1:
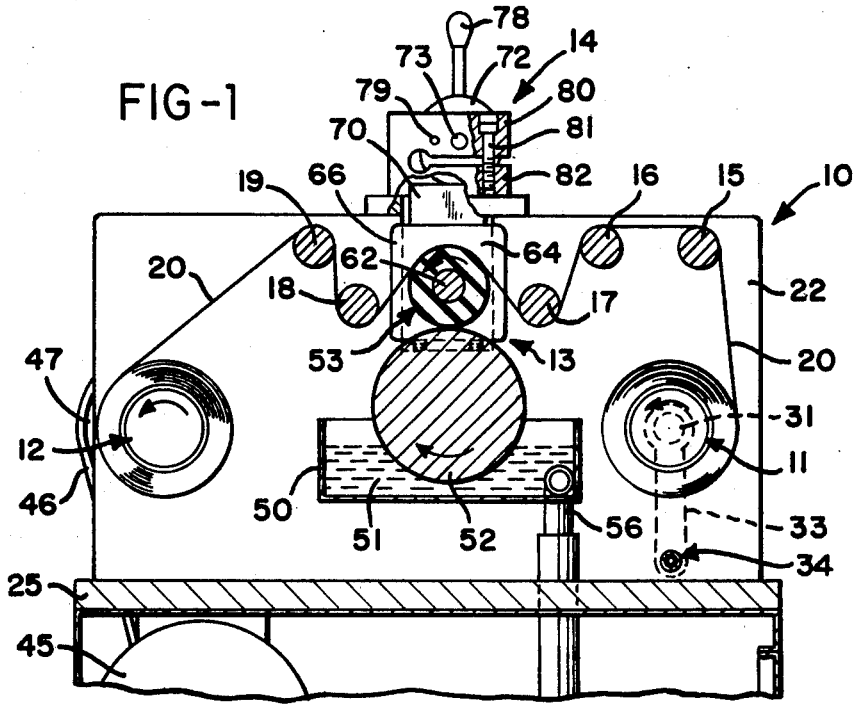
FIG. 1 is a cross-sectional view, taken along lines 1—1 of an improved reinking apparatus in accordance with the present invention.

As shown in FIG. 1, the improved reinking apparatus 10 basically comprises a feed roller means 11, takeup or collecting roller means 12, an inking fountain 13 located centrally between the feed and collecting rollers, and control means 14 for controlling the amount of flow of the reinking composition. Guide bars 15–19 provide a means to guide a ribbon 20 toward and away from inking fountain 13 where it will become recoated with ink so that it can subsequently be reused.

A supporting framework is provided for these rollers and bars, as follows. Vertical end plates 21–24, with plates 21 and 22 being inside and plates 23 and 24 outside, are provided to support the roller, guide and inking means, while base plate 25 in turn supports the end plates 21–24. Base plate 25 may itself be supported as by placing it on a cabinet or the like (only the top is shown) which can be used to store supplies as well as to house motors to drive the takeup roller means and a reinking composition recirculating system of the like.

Feed and takeup roller means 11 and 12 are rotatably supported by end plates 21–24, while guide means 15–19 will be fixedly supported between plates 21 and 22 and comprise chrome-plated steel bars or the like. Alternatively, some or all of the guide bars 15–19 could be rotatably mounted.

Feed roller means 11 comprises a pair of identical spools 30 which are rotatably supported by journals or shafts 31 which are axially slidable (as indicated by arrows 32), as well as rotatable, in end plates 21–24. Collars 33, at the ends of shafts 31, limit axial movement in one direction, while the spools 30 limit axial movement in the other direction. In addition, spools 30 are spring biased toward one another by spring biasing means 34 which comprises a pair of rods 35 attached to and extending toward one another from collars 33 and joined by spring 36. The rods 35 are axially slidable in sleeve 37 which passes through end plates 31–24. The spools 30 are of a conventional construction and are adapted to support between them a hollow cylindrical core (not shown) on which the ribbon 20 is wound or coiled.

Thus to mount a ribbon containing core, the spools 30 are pulled apart by grasping collars 33 and moving them, as well as shafts 31 and spools 30, axially away from themselves. In doing so, the bias of spring 36 is overcome. The spools 30 are then inserted inside the core and moved back towards one another by the bias of spring 36. The core having the ribbon 20 thereon will be pinned between the spools 30, which fit inside the core and which are held in place by spring 36. The feed roller means 11 will be free to move axially, as a unit to adjust for winding irregularities which might have occurred when the ribbon was initially wound on the core. An alternative to having the core be held on the spools by the spring 36 would be to have the spools 30 merely frictionally engage the core.

The takeup means 12 is basically the same as the feed means 11 in that spools 40 and 41 support a core (not shown) which is placed between them and upon which the reinked ribbon will be collected by winding in a conventional manner, such as by wrapping the ribbon on the core for a first turn which frictionally holds the tape on. But the shafts 42 and 43, respectively, are not free to move axially as in the case with shafts 31 when the apparatus 10 is in operation, and so a different spring biasing arrangement is used. Shaft 42 is mounted for rotation in end plates 21 and 23, and is axially movable to allow a core to be mounted between spools 40 and 41, while being spring biased by spring 44 to restrain the collecting roll means 12 from otherwise moving axially. Shaft 43 is mounted for rotation in end plates 22 and 24, and is fixed against axial movement.

Thus, shaft 42 can be manually shifted axially by overcoming spring 44 to insert a core (not shown) between the spools 40 and 41. The spring 44 will return spool 40 toward spool 41 and hold the core in place. Collecting means 12 is rotatably driven by motor 45 through a drive belt 46 which is connected over a driven pulley 47 on shaft 43, located between the inner and outer end plates 22 and 24.

Inking fountain 13 basically comprises a reservoir 50 containing a supply of reinking composition 51, a feed or ductor roller 52 which picks up an amount of the reinking composition on its surface, and an inking roller 53 which transfers an amount of reinking composition from ductor roller 52 to ribbon 20 which is brought into surface contact with inking roller 53 by guide bars 17 and 18.

Figure 2:
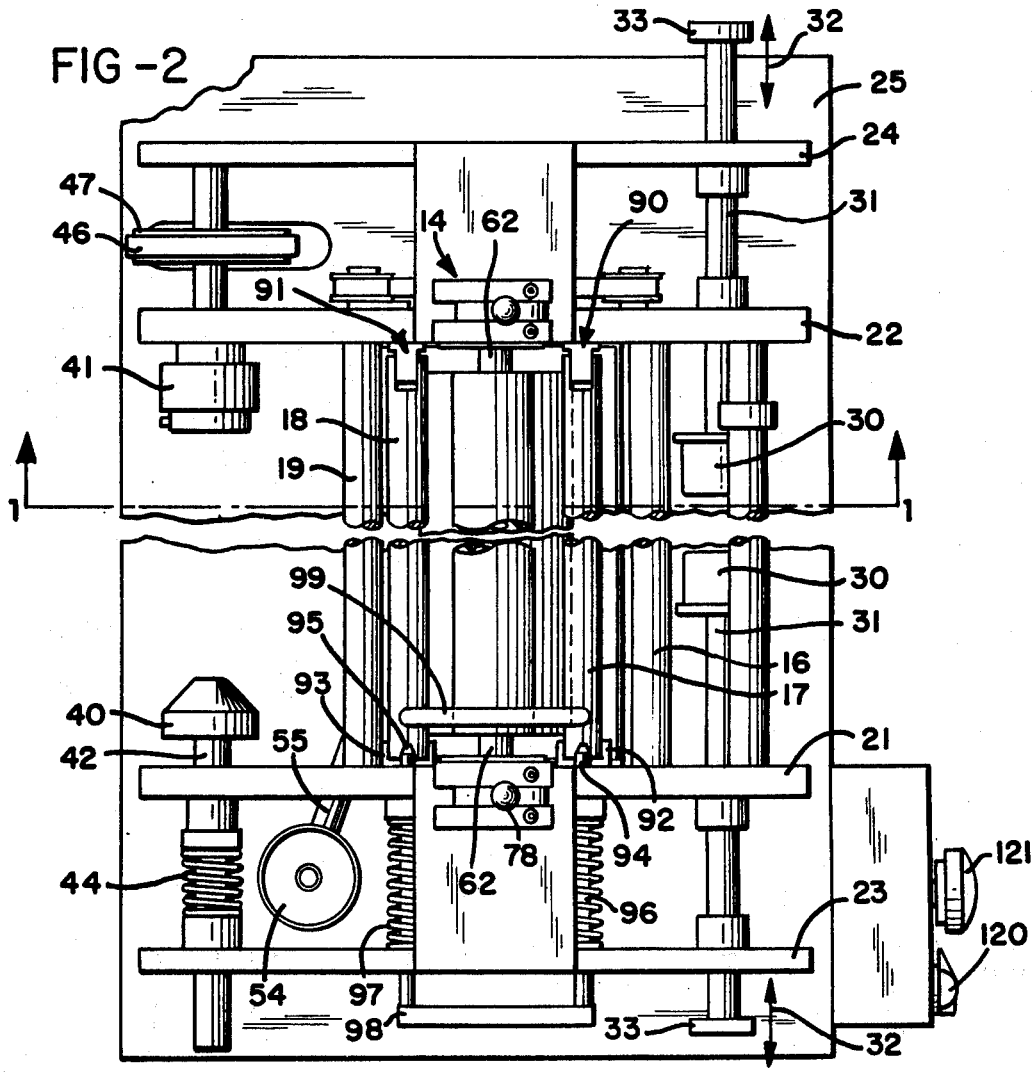
FIG. 2 is a plan view, partially broken away of the reinking apparatus of FIG. 1.

The reservoir 50, feed roller 52, and inking roller 53 are all in a generally vertical alignment. The inking fountain 13 is conventional in the art, with feed roller 52 comprising a chrome or stainless steel drum and inking roller 53 having a rubber or synthetic resilient polymer surface. Reservoir 50 is a generally rectangular open container in which ductor roller 52 is partially submerged and rotates so that a portion of reinking composition is picked up on its peripheral surface. Appropriate means such as funnel-like inlet 54 (FIG. 2) and inlet pipe 55 are provided to supply reinking composition 51 to reservoir 50. Drain pipe 56 is provided in the bottom of reservoir 50 so that reinking composition 51 may be drained, filtered by filter 57, and recirculated back to reservoir 50 by pump 58 and return line 59, as necessary. Filtration and recirculation are desirable when reinking computer ribbons because they tend to have paper particles on their surface which become punched out of the paper on which the computer output is printed by the printing hammers of the computer printers. The particles fall from the ribbon into the reinking composition supply during reinking and, if not filtered out, may be picked up and deposited on the reinked ribbon.

Figure 3:
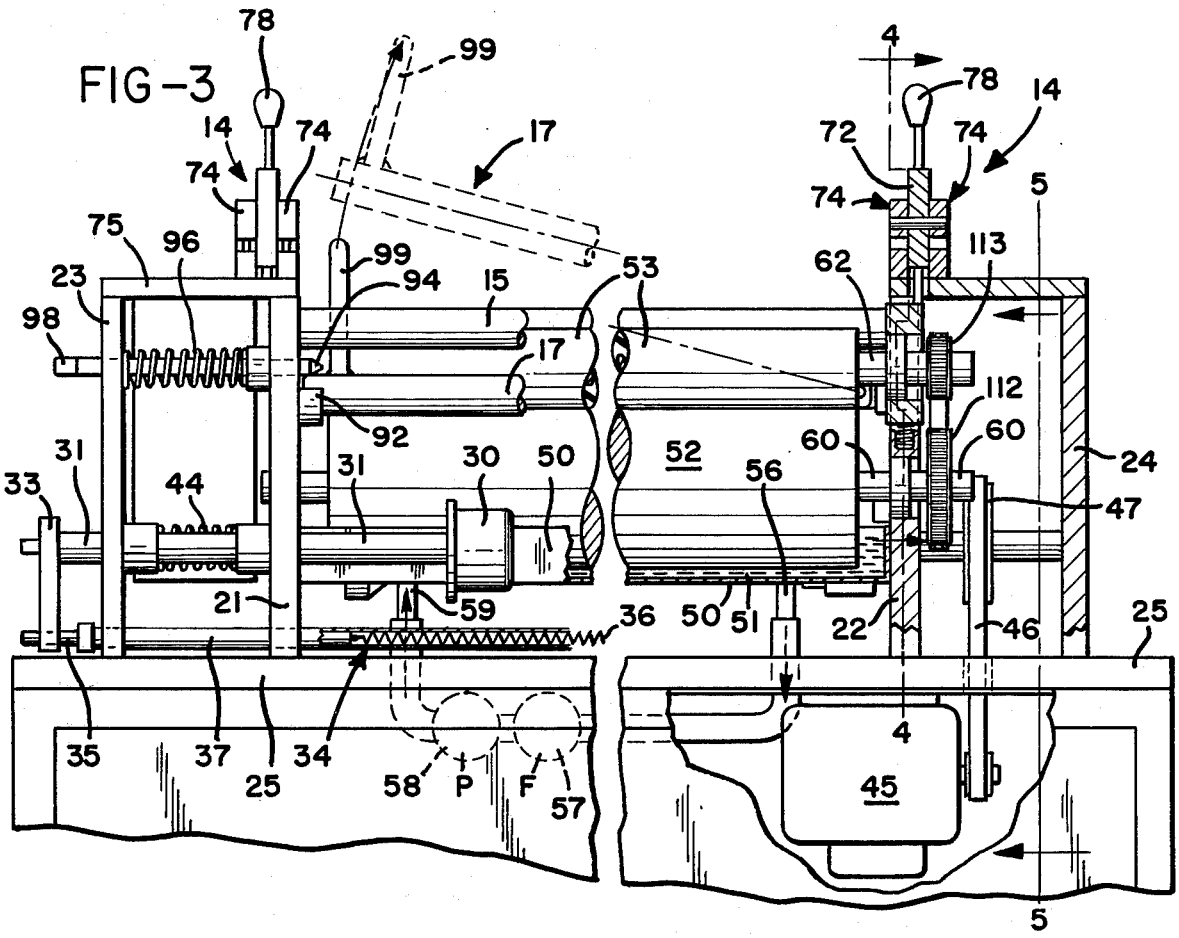
FIG. 3 is a front elevational view, partially broken away, of the reinking apparatus of FIG. 1.
Figure 4:
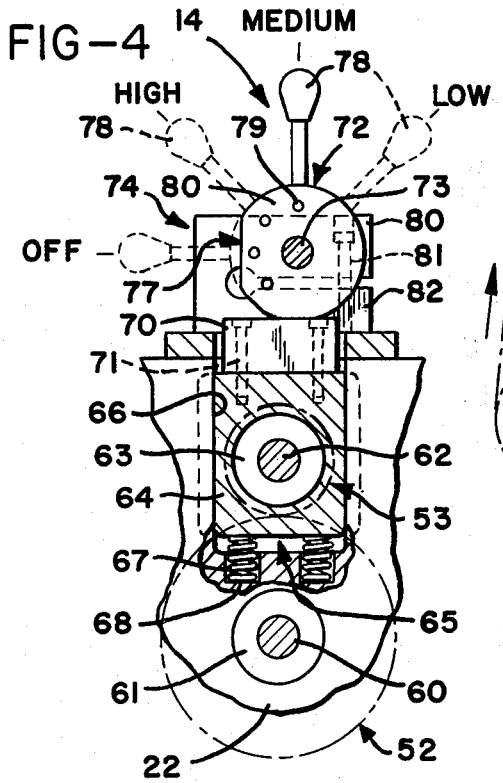
FIG. 4 is a cross-sectional view, partially broken away, along lines 4—4 in FIG. 3.

Both the ductor roller 52 and the inking roller 53 are supported for rotation in the inner end plates 21 and 22. Ductor roller 52 is supported by journals 50 in fixed bearings 61 (FIGS. 3 and 4), while inking roller 53 is journaled, at 62, into bearings 63 in guide blocks 64 which are free to move up and down in U-shaped openings 65 in plates 21 and 22. Grooves or channels 66 in the edges of the blocks hold the blocks 64 in the U-shaped openings 65. Springs 67, which are located in appropriate holes 68 in the bottom of the openings 65, support the blocks 64, and hence bias the inking roller 53 away from the ductor roller 52 which is fixed against vertical movement.

It is the positional or spatial relationship between the feed roller 52 and inking roller 53, which determines the amount of inking composition transferred from the feed roller 52 to the inking roller 53 and consequently to the ribbon 20. The ink transfer process, per se, is conventional in the art. It is the control of the spatial relationship which is of particular significance to the improved reinking apparatus 10.

Blocks 64 have on the opposite side from the spring biasing means 67, i.e., the top, a cam follower 70 attached thereto by screws 71. Cams 72 are mounted for rotation above and in contact with followers 70. Cams 72 are rotatably supported by shafts 73 which pass through both cam 72 and mounting blocks 74. These blocks extend from support plates 75 and 76 which are attached to plates 21 and 23, and 22 and 24, respectively.

Cam 72 is in continuous contact with follower 70, and exerts a force in opposition to springs 63. Thus, springs 67 force feed roller 52 and inking roller 53 apart, and cams 72 force them together. Cams 72 have an essentially circular shape. By creating eccentricities on the surface of cam 72, such as by creating flat spots or out of round portions on the peripheral surface of the cam 72 such that the distance from the point of rotation, i.e., shaft 73, is less than the radius which generally describes the cam, varying amounts of force will be exerted by cam 72 as it is rotated because block 64 will be forced downward, or allowed to rise upward, varying distances from the full radius of the cam to whatever extent this has been lessened. In this way positional or spatial relationship can be altered to vary the amount of reinking composition transferred. An extreme flat spot, such as flat 77, is provided to allow the positional relationship to become such that no reinking composition will be transferred, i.e., it is the off position. Handle 78 provides a convenient grip to rotate cam 72.

While cam 72 is susceptible to an almost infinite variety of peripheral surface variations, it is preferable to provide certain set positions or stops. This can be provided by a ball detent arrangement 79, such as is conventional in the art, comprising a ball retained in an appropriate recess in one of the blocks 74 and supported and biased by an appropriate spring (not shown) toward a series of indentations in the side of cam 72 facing the block 74 which retains the ball and spring. Four indentations are provided, and so the cam will have four positions or stops: low, medium, high and off. If the desired amount of adjustment in the spatial relationship is, e.g., 0.001 inch closer, the spatial relationship can be adjusted plus or minus one-thousandth of an inch by merely rotating the cam between the stops. Cam feed control means 14 are provided at each end of the inking means 13 so that variations in the reinking composition flow at the ends of the inking means 13 can be adjusted.

A further means for adjusting the positional relationship is provided by making the blocks 74 which support the cams 72 essentially C-shaped, with shafts 73 being mounted in the upper parts 80 of blocks 74. The blocks 74 are normally made of metal, but the generally C-shaped upper portion 80 will possess a limited upward and downward resiliency or flexibility because of its shape. By threading a screw 81 through upper portion 80 into lower portion 82, the two portions can be brought toward one another with upper portion 80 being forced downward toward lower portion 82. As screw 81 is loosened, the upper portion 80 will tend to return in an upward direction. By moving upper portion 80 up and down, shaft 73 is consequently moved up or down because the center of rotation of cam 72 will be varied. If the initial spacing or positional relationship is set by varying the center of rotation for shaft 73 using screw 81, the rotation of cam 72 will provide an adjustment additional to the screw adjustment 81, i.e., the cam can provide a "fine adjustment". Thus, once apparatus 10 is in operation, the positional relationship can be easily adjusted by cam adjustment means 72 using handle 78. There is no criticality in the shape of the blocks 74. What is important is that upper portion 80 have some flexibility or resiliency so that the center of rotation of cam 72 can be varied as related therein.

As shown in FIG. 1, an installed ribbon 20 must pass over guide bars 15 and 16, under guide bar 17, over inking roller 53, under guide bar 18, over guide bar 19 to take-up means 12. For ease in installation, guide bars 17 and 18 which hold the ribbon 20 in contact with inking roller 53 are pivotally connected to end wall 22 by means of pivots 90 and 91. The opposite ends thereof will be supported in end wall 21 by U-shaped supports 92 and 93 and retained therein by latches 94 and 95. Latches 94 and 95 will be spring loaded by springs 96 and 97. In order to move guide bars 17 and 18 out of the way so that a ribbon 20 may be installed, latches 94 and 95 are pulled axially out of the way by handle 98, overcoming springs 96 and 97. By grasping handle 99 which interconnects guide bars 17 and 18 the guide bars can be swung out of the way as shown in phantom lines in FIG. 3. The ribbon 20 which is mounted on a core (not shown) is supported between spools 30 of feed means 11 and is passed over guides 15, 16, and 19 into engagement with a core (not shown) supported by spools 40 and 41. When guide bars 17 and 18 are pivoted back into place they will come down on ribbon 20 on either side of inking roller 53 and forcing ribbon 20 into contact with inking roller 53.

Figure 5:
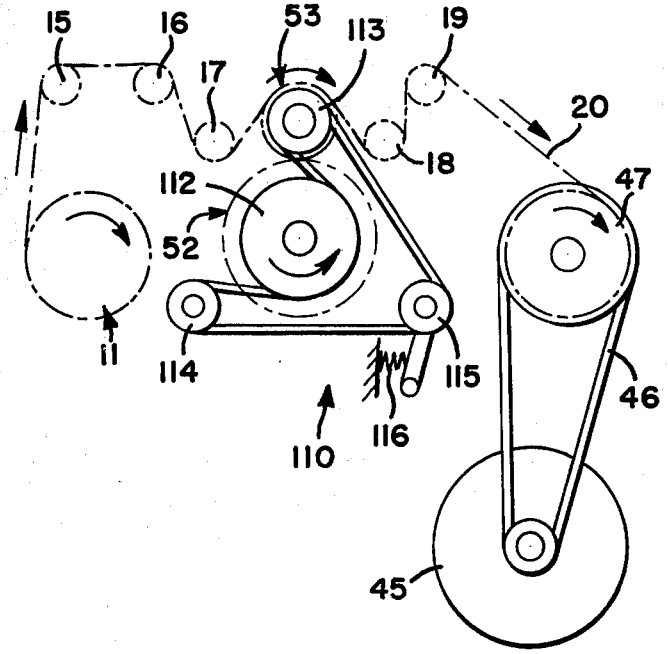
FIG. 5 is a schematic view, taken along lines 5—5 in FIG. 3, of the drive means employed in the improved reinking apparatus of the invention.

The means necessary to move ribbon 20 through apparatus 10 is the drive means connected to take-up means 12, as discussed earlier, which in turn drives feed means 11, as well as inking roller 53 because of the frictional contact with the peripheral surface thereof. Although inking roller 53 and feed roller 52 will be in frictional contact, they are interconnected by a timing means 110 which is shown in FIG. 5 and is conventional in the art. Timing belt 111 interconnects timing gears 112 and 113 on journals 60 and 62 of feed roller 52 and inking roller 53, respectively, as well as idler roller 114 and tension roller 115. Spring 116 provides the tension necessary to keep timing belt 111 in friction contact with timing gears 112 and 113 and compensates for adjustments in the spatial relationship between the feed and inking rollers 52 and 53.

An appropriate electrical power source (not shown) will be provided for motor 45, as well as any other electrical equipment, such as the recirculation pump. The power source will be controlled by a switch 120 which also turns apparatus 10 on and off. A further switch 121 is provided to control the speed of the connecting means 12. Such a speed control will comprise a rheostat or the like conventional device.

While the form of apparatus herein described constitutes a preferred embodiment of the invention, it is to be understood that the invention is not limited to this precise form of apparatus, and that changes may be made therein without departing from the scope of the invention.

What is claimed is:

1. In an apparatus of the character described for reinking ribbons including a supporting framework, means on said framework for feeding the ribbon to be reinked, means on said framework for collecting the reinked ribbon, means for driving said collecting means, inking means for applying a reinking composition to the ribbon including a reservoir for holding a supply pool of reinking composition for application to the ribbon, a feed roller extending partially into the pool of the reinking composition, an inking roller receiving the reinking composition from said feed roller, means guiding the ribbon into contact with said inking roller to apply the composition to the ribbon, means on said framework supporting said feed roller in fixed position, blocks movably connected to said framework and supporting said inking roller for movement toward and away from said feed roller, spring means acting on said blocks biasing said inking roller away from said feed roller, adjustment means fixed to said framework and having a movable part, and means for controlling the position of said movable part relative to said framework;

the improvement comprising adjustable cam means mounted on said movable part and in contact with said blocks to move said reinking roller against said spring means independently of said adjustment means for changing the predetermined positional relationship of said rollers whereby the amount of reinking composition transferred to said inking roller from said feed roller may be varied with reference to the predetermined position.

2. An apparatus as defined in claim 1, wherein said cam means includes rotatable cams contacting each of said blocks, shafts rotatably supporting said cams, and means mounting said shafts on said adjustment means in spaced relation to said feed roller whereby rotation of said cams acts to move said blocks against said spring means to change the positional relationship of said inking roller and feed roller established by said adjustment means.

3. Apparatus as defined in claim 2, including detents operable on said cams to define predetermined positions of each of said cams.

4. In an apparatus for reinking ribbons including supply means for holding a porous ribbon to be reinked and collecting means for taking up the ribbon from said supply means, drive means for rotating said collecting means, and means for guiding the ribbon along a predetermined path between said supply and connecting means, a reservoir for holding a supply of relatively volatile reinking composition, an inking roller for applying reinking composition to the ribbon, a feed roller arranged to transfer reinking composition from said reservoir to said inking roller, guide blocks supporting opposite ends of said inking roller, means on said frame confining said guide blocks for movement toward and away from feed roller, springs biasing said guide blocks to move said inking roller away from said feed roller, mounting blocks each having a lower part fixed to frame and an upper movable part movable with respect to said lower part, adjustable spacing screws controlling the position of said movable parts, cams carried on said movable parts and contacting roller block, and means for adjusting the position of each of said cams to adjust the positional relationship between said inking roller and said feed roller established by said spacing screws.

* * * * *